US006367399B1

(12) United States Patent
Khachaturian

(10) Patent No.: US 6,367,399 B1
(45) Date of Patent: Apr. 9, 2002

(54) METHOD AND APPARATUS FOR MODIFYING NEW OR EXISTING MARINE PLATFORMS

(76) Inventor: Jon E. Khachaturian, 5427 Sutton Pl., New Orleans, LA (US) 70131

( * ) Notice: Subject to any disclaimer, the term of this patent is extended or adjusted under 35 U.S.C. 154(b) by 0 days.

(21) Appl. No.: 09/454,733

(22) Filed: Dec. 6, 1999

Related U.S. Application Data

(63) Continuation of application No. PCT/US98/17985, filed on Aug. 31, 1998, which is a continuation of application No. 08/915,671, filed on Aug. 21, 1997, now abandoned, which is a continuation of application No. 08/915,925, filed on Aug. 21, 1997, now Pat. No. 5,975,807, which is a continuation-in-part of application No. 08/709,014, filed on Sep. 6, 1996, now Pat. No. 5,800,093, which is a continuation-in-part of application No. 08/615,838, filed on Mar. 14, 1996, now Pat. No. 5,662,434, which is a continuation-in-part of application No. 08/501,717, filed on Jul. 12, 1995, now Pat. No. 5,607,260, which is a continuation-in-part of application No. 08/404,421, filed on Mar. 15, 1995, now Pat. No. 5,609,441.

(51) Int. Cl.[7] ..... B63B 1/00
(52) U.S. Cl. ..... 114/61.1; 405/204
(58) Field of Search ..... 114/31, 33, 44, 114/46, 48, 49, 53, 61.14, 258, 259, 61.1; 405/204

(56) References Cited

U.S. PATENT DOCUMENTS

| | | | | |
|---|---|---|---|---|
| 928,536 A | | 7/1909 | Pino | 114/51 |
| 1,710,103 A | | 4/1929 | Nelson | 114/51 |
| 2,598,088 A | | 5/1952 | Wilson | 61/46 |
| 3,977,346 A | | 8/1976 | Natvig et al. | 114/65 R |
| 4,242,011 A | | 12/1980 | Karsan et al. | 405/204 |
| 4,249,618 A | | 2/1981 | Lamy | 405/204 X |
| 4,252,468 A | | 2/1981 | Blight | 405/204 |
| 4,252,469 A | | 2/1981 | Blight et al. | 405/204 |
| 4,714,382 A | | 12/1987 | Khachaturian | 405/204 |
| 4,744,697 A | | 5/1988 | Coppens | 405/204 |
| 5,037,241 A | | 8/1991 | Vaughn et al. | 405/209 |
| 5,607,260 A | * | 3/1997 | Khachaturian | 405/204 |
| 6,039,506 A | * | 3/2000 | Khachaturian | 405/204 |
| 6,149,350 A | * | 11/2000 | Khachaturian | 405/204 |

* cited by examiner

*Primary Examiner*—Jesus D. Sotelo
(74) *Attorney, Agent, or Firm*—Garvey, Smith, Nehrbass & Doody, LLC

(57) ABSTRACT

A method and apparatus for the salvage or installation of large multi-ton marine platform includes the use of usually two barges defining a base that can support a large multi-ton load. A lifting assembly is supported by the barge and forms a load transfer interface between the barge and the deck package. Each boom has a lifting end portion that fits a supplemental lifting frame attached to the platform. During removal of the platform from its underlying support (e.g. jacket), there are winches with cables that pull the barges together as the booms lift the supplemental lifting frame and the supported platform. The supplemental frame includes both horizontal and diagonal beams that interface with the platform to transmit load to the lower end of the platform.

29 Claims, 6 Drawing Sheets

METHOD AND APPARATUS FOR MODIFYING NEW OR EXISTING MARINE PLATFORMS

CROSS-REFERENCE TO RELATED APPLICATIONS

Incorporated herein by reference are the following applications:

This application is a continuation PCT Application No. PCT/US98/17985; filed Aug. 31, 1998; and a provision of U.S. patent application Ser. No. 08/925,929, filed Sep. 08, 1997 now U.S. Pat. No. 6,039,506; which is a continuation of U.S. patent application Ser. No. 08/915,671, filed Aug. 21, 1997 abandoned; and a continuation of U.S. patent application Ser. No. 08/915,925, filed Aug. 21, 1997; U.S. patent application Ser. No. 08/925,929, filed Sep. 08, 1997; and a continuation-in-part of U.S. patent application Ser. No. 08/709,014, filed Sep. 06, 1996, which is a continuation-in-part of U.S. patent application Ser. No. 08/615,838, filed Mar. 14, 1996, which is a continuation-in-part of U.S. patent application Ser. No. 08/501,717, filed Jul. 12, 1995, now U.S. Pat. No. 5,607,260, which is a continuation-in-part of U.S. application Ser. No. 08/404,421 filed Mar. 15, 1995, now U.S. Pat. No. 5,609,441.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the salvage or installation of marine platforms and oil rigs that are supported upon a usually partially submerged jacket that extends between the seabed and the water surface. Even more particularly, the present invention relates to the use of a moving lifting assembly which is preferably barge supported that can remove and salvage or install very large marine platforms without the use of enormous lifting booms such as form a part of derrick barges, offshore cranes, and the like. The present invention features opposed short booms that are connected with an improved lifting arrangement to the lower end of the platform to be salvaged or installed.

2. General Background

In the offshore oil and gas industry, the search for oil and gas is often conducted in a marine environment. Sometimes the search takes place many miles offshore. Oil and gas well drilling takes place in many hundreds of feet of water depth.

The problem of drilling oil wells offshore and then producing these wells has been solved in part by the use of enormous fixed or floating platform structures with foundations that are mostly submerged, but usually extending a number of feet above the water surface. Upon this foundation (or "jacket", tension leg platform ("TLP"), or SPAR, etc. referred to in the art) there is usually placed a very large prefabricated rig, deck, or platform.

The term "platform" as used herein should be understood to include any of a large variety of prefabricated structures that are placed in a marine environment, e.g., on an offshore foundation (e.g. jacket), to form a fixed or floating offshore platform. Thus, a "platform" can include, e.g. a drilling rig, a production platform, a crew quarters, living quarters, or the like.

A supporting jacket is usually a very large multi-chord base formed of multiple sections of structural tubing or pipe that are welded together. Such jackets have been used for a number of years for the purpose of supporting large deck platforms in an offshore environment.

The jacket or foundation is usually prefabricated on land in a fabrication yard, preferably adjacent to a navigable waterway. The completed jacket can be placed upon a large transport barge so that it can be moved to the drill site where it will be placed upon the ocean floor. As an example, an offshore jacket can be several hundred feet in length. The size of the jacket is of course a function of the depth of water in which the rig will be placed. A five hundred (500) foot water depth at the drill site (or production site) will require a jacket which is approximately 500–550 feet tall. The jacket is usually partially submerged, with only a small upper portion of the jacket extending slightly above the water surface. An offshore jacket as described and in its position on the seabed can be seen, for example, in the Blight, et al U.S. Patent No. 4,252,469 entitled "Method and Apparatus for installing integrated Deck Structure and Rapidly Separating Same from Supporting Barge Means." Specifically, FIGS. 1, 2 and 3 of the Blight, et al patent show an offshore jacket on the seabed.

A small upper portion of the jacket extends above the water surface. This exposed portion of the jacket is the portion upon which the platform is placed and supported by. The upper portion of the jacket is usually equipped with a number of alignment devices which enhance the proper placement of the deck package on the jacket. Such alignment devices are referred to variously as stabbing eyes, sockets, or the like. The use of such alignment devices, sockets, or stabbing eyes can be seen in the Blight, et al U.S. Pat. Nos. 4,252,468 and U.S. Pat. No. 4,252,469 as well as in the Kansan U.S. Pat. No. 4,242,011. For purposes of background and reference, the Kansan patent U.S. Pat. No. 4,242,011 is incorporated herein by reference. The Blight, et al U.S. Pat. Nos. 4,252,469 and 4,252,468 are likewise each incorporated herein by reference.

Platforms or topsides can be extremely large and have correspondingly heavy weights. For example, it is not uncommon for a deck platform such as a drilling rig crew quarters, production platform or the like to be between five hundred and five thousand (500 and 5,000) tons gross weight. Topsides in excess of ten thousand (10,000) tons have been installed, and others that are being planned may weigh as much as thirty thousand (30,000) tons. Such enormous load values present significant problems in the placement of deck platforms on offshore jacket structures. First, the placement is done entirely in a marine environment. While the jacket can be laid on its side and/or floated into position, the platform is not a submersible structure, and must be generally supported in an upright condition above the water surface to prevent water damage to the many components that form a part of the drilling or production platform (such as electrical systems, wall constructions, and other portions that will be inhabited by individuals and used as oil and gas well drilling or production equipment).

After a number of years, offshore marine platforms can become obsolete and are abandoned. Once abandoned, these platforms become a hazard to navigation and must necessarily be removed.

The art has typically used enormous derrick barges for the purpose of removing abandoned platforms from their supporting jackets in an offshore environment. These derrick barges are large, rectangular barge structures with a high capacity lifting boom mounted at one end portion of the deck of the barge. The barge, for example might be three hundred to four hundred (300–400) feet in length, fifty to one hundred twenty (50–120) feet in width, and twenty-five to fifty (25–50) feet deep. These figures are exemplary.

A derrick barge might have a lifting capacity of for example, two thousand (2,000) tons. For very large structures such as for example, a five thousand (5,000) ton deck package, two derrick barges can be used, each supporting one side portion of the deck platform with a multi-line lift system supported by an enormous structural boom extending high into the air above the package during the lift.

While the use of such derrick barges has been successful in the removal of platforms and/or jackets through the years, such derrick barges are generally limited in their capacity to packages of two thousand (2,000) tons or less. Further, derrick barges of such an enormous capacity are extremely expensive to manufacture and operate. Many thousand of dollars per hour as a cost of using such a device is not uncommon. Although there are five (5) or six (6) derrick barges that can lift in excess of six thousand (6,000) tons, they are extremely costly and limited as to the water depth in which they can operate.

When very large loads of, for example six thousand—ten thousand (6,000–10,000) tons are involved, the limitation of the derrick barge usually prohibits such a lift.

In U.S. Pat. No. 4,714,382 issued to Jon Khachaturian there is disclosed a method and apparatus for the offshore installation of multi-ton prefabricated deck packages on partially submerged jacket foundations. The Khachaturian patent uses a variable dimensional truss assembly and is supported by the barge and forms a load transfer interface between the barge and the deck package. Upper and lower connections form attachments between the truss members and the deck package at upper and lower elevational positions on the deck package. The variable dimension truss includes at least one member of variable length, in the preferred embodiment being a winch powered cable that can be extended and retracted by winding and unwinding the winch. Alternate embodiments include the use of a hydraulic cylinder as an example. Other Khachaturian patents include U.S. Pat. Nos. 5,607,260; 5,609,441; 5,662,434; 5,800,093; and 5,975,807; each of which is hereby incorporated herein by reference.

An earlier patent, U.S. Pat. No. 2,598,088 issued to H. A. Wilson entitled "Offshore Platform Structure and Method of Erecting Same" discusses the placement of drilling structure with a barge wherein the legs of the drilling structure are placed while the drilling structure is supported by two barges. The Wilson device does note use truss-like lifting assemblies having variable length portions which are placed generally on opposite sides of the deck package. Rather, Wilson relates to a platform which is floated in place and the support legs are then placed under the floating platform. Thus, in the Wilson reference, an in-place underlying supporting jacket is not contemplated.

The Natvig, et al U.S. Pat. No. 3,977,346 discusses a method of placing a deck structure upon a building site such as a pier. The method includes the pre-assembly of a deck structure upon a base structure on land so that the deck structure extends outwardly over a body of water. Floating barges are provided for supporting the deck structure outwardly of the building site. The deck structure is then transferred to the supportive base structure by means of barges. The Natvig reference uses two barges which are placed on opposite sides of a platform with pedestal type fixed supports forming a load transfer member between the barges and the platform. However, the fixed pedestal of Natvig is unlike the truss-like lifting arrangement of applicant which include movable portions at least one of which can be of a variable length.

U.S. Pat. No. 4,249,618, issued to Jacques E. Lamy, discloses a method of working an underwater deposit comprising the following stages: a) constructing and positioning a platform structure, equipped before or after positioning with drilling devices and installations, b) executing drilling using these devices and installations, c) constructing and equipping, during stages a) and b), a production bridge fitted with devices and installations required for production, d) transporting the production bridge to, and positioning it on, said platform structure, and e) commencing production from deposit. The drilling bridge may remain in position on the platform structure during stages d) and e) or it may be removed to make way for the production bridge.

U.S. Pat. No. 4,744,697, issued to Anton Coppens, discloses a vessel that is provided for installing or removing a module on or from a support structure erected in a body of water. The vessel is able to suspend the module over the support structure by cranes enabling installation or removal of the module to be accomplished while the module is being suspended.

U.S. Pat. No. 5,037,241, issued to Stephen D. Vaughn et al. discloses an improved apparatus for setting a deck structure or other marine superstructure using a barge mounted cantilevered support structure. The cantilevered support structure is attached at one end of a floating vessel. The cantilevered support structure extends past the edge of the vessel and, in one embodiment, includes means for rotating parallel support members about the deck of the floating vessel permitting the cantilevered support structure to be raised and lowered while it remains substantially parallel with the top of the offshore platform enabling the superstructure to engage the top of a previously installed offshore platform in a synchronized manner. Alternatively, this superstructure may be aligned directly over the platform. A cantilevered drilling rig is then aligned over the cantilevered support structure and used to lift the deck structure or marine superstructure, permitting the vessel and cantilevered support structure to move. The drilling rig is then used to lower the marine superstructure onto the top of the previously installed offshore platform.

BRIEF SUMMARY OF THE INVENTION

The present invention provides a catamaran work barge apparatus for lifting and removing a marine platform to be salvaged or installed. The apparatus includes a pair of barges, each providing a deck area with a base that can support a large multi-ton load.

Each barge provides a plurality of diagonally extending lift booms. Each boom is preferably pivotally supported upon the barge that it is connected to. Each lift boom has a lower end portion that attaches to the barge on a base and an upper end portion that includes a free end with a lifting end portion.

Lower connection members are provided for forming attachments between the barges and the platform to be lifted and salvaged or installed.

A supplemental lifting frame is provided that is connectable to the package to be lifted and salvaged or installed. The supplemental lifting frame includes receptacles that receive the free end portions of the booms during a lift.

The supplemental lifting frame can include horizontal beams and diagonal beams associated with each boom.

In the preferred embodiment, there are pairs of booms that align, each of said pairs being positioned respectively on opposite of the barges. For example, in the preferred embodiment, there are four booms on each barge, producing an overall four pair of aligned booms.

Horizontal load spreader surfaces can be placed on the barges and spaced generally on opposite sides of the package being lifted. These load spreader surfaces or base members are at the base of each boom and pivotally support the boom, spread the load to the barge structure as required and also provide sliding or horizontal adjustment of the base of some or all booms relative to the barge upon which they are supported.

The supplemental lifting frame preferably comprises horizontal beams that span between booms on opposite of the barges, diagonal booms that extend from an end portion of a horizontal beam to the lower end portion of the platform and a connection that joins the horizontal beams and diagonal beams with a pinned arrangement that disallows substantial bending moment in the horizontal beam and in the platform leg.

Each boom can be provided with a winch with a cable wound thereupon. The lower connections can include cables such as winch cables that span between the barges and the platform.

The present invention provides a method for the offshore salvage or installation of a fixed offshore platform. The method includes transporting a catamaran work platform to a desired site of the fixed offshore structure. The catamaran work platform including a pair of barge supported decks that are positioned at spaced apart and generally parallel positions relative to one another.

A lifting assembly is attached to the platform at multiple positions, including positions that are at least on generally opposite sides of the platform, and at upper and lower positions on the platform. The lifting assembly includes two opposed lifting booms, each connected by at least one lifting end portion to a frame that is attachable to the platform. The method further comprises pulling the two barge decks together.

In the method, the frame includes a horizontal beam that spans between the upper end portion of two aligned booms.

The method further comprises the step of subjecting the horizontal beams of the frame to compression only and little or no bending moment during the lift.

There are preferably two opposed lift barges as part of the method, each being a separate floating barge. However, a one piece barge construction could be provided that has separate spaced apart decks that carry the respective sets of lifting booms.

The lifting assembly can include a plurality of non-extensible diagonally extending lift booms, each removably connected at its ends to an end cap. dr

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
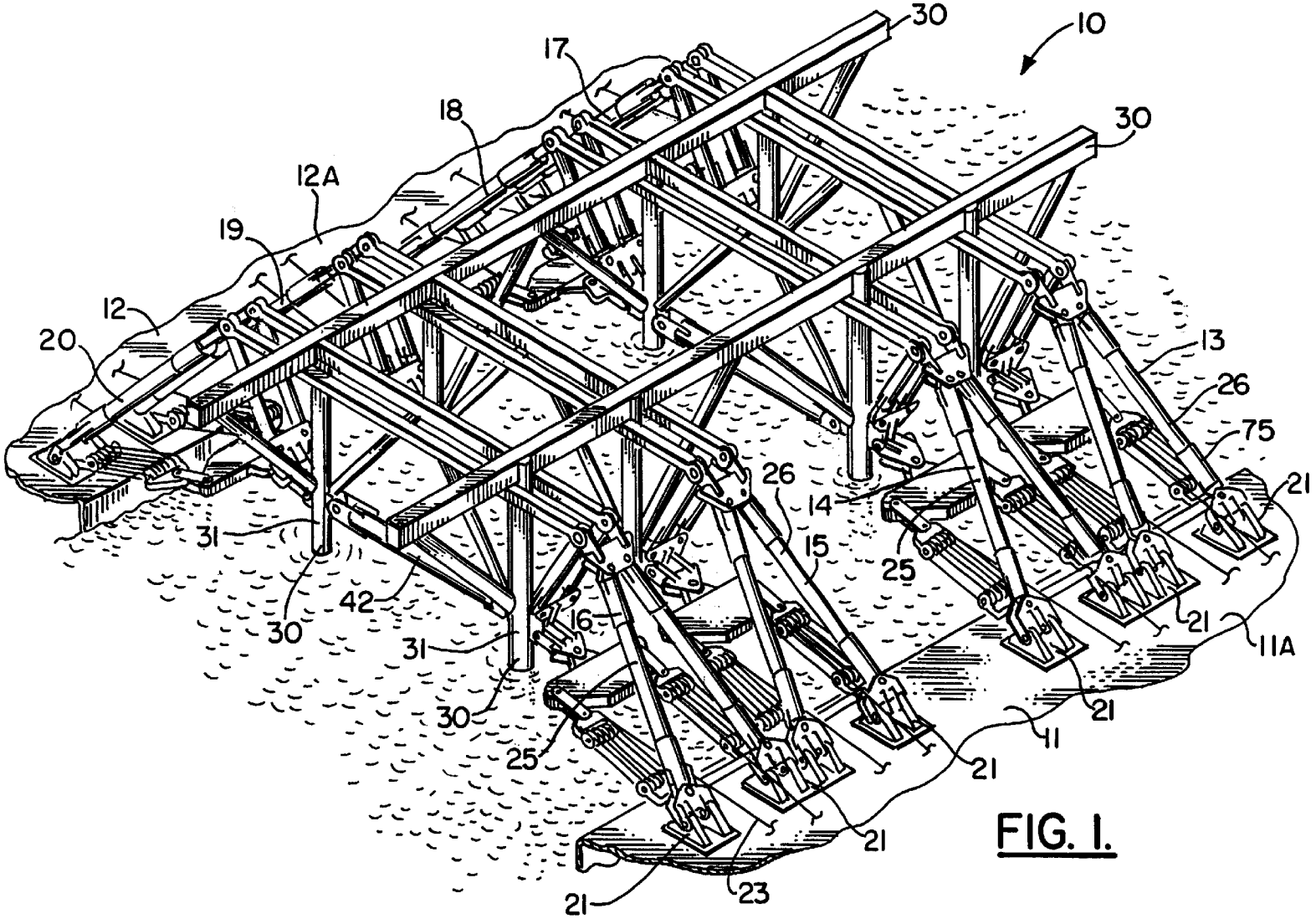
FIG. 1 is a perspective view of the preferred embodiment of the apparatus of the present invention.

FIG. 1 shows the preferred embodiment of the apparatus of the present invention designated generally by the numeral 10. Marine platform lifting apparatus 10 includes spaced apart barges 11, 12 that can provide deck surfaces for supporting a plurality of booms and winches. In FIG. 1, the barge 11 provides a deck surface 11A having a plurality of booms 13, 14, 15, 16, each pivotally mounted thereon. Barge 12 provides a deck surface 12A with a corresponding plurality of booms 17, 18, 19, 20.

The booms 13–20 are paired, with opposing booms being aligned along a plane of rotation with each other. Booms 13 and 17 are aligned and form a plane with their pivotal or rotational arcs. Likewise, pairs of aligned booms include 14 and 18, 15 and 19, and 16 and 20. Each of the booms 13–20 is supported upon a base 21 that can be comprised of a frame, pad eyes, and pinned connections, so that each boom 13–20 is pivotally movable at the barge 11 or 12 and with respect to the barge 11 or 12. Each base 21 is a load transfer interface between a boom and its barge.

Figure 12:
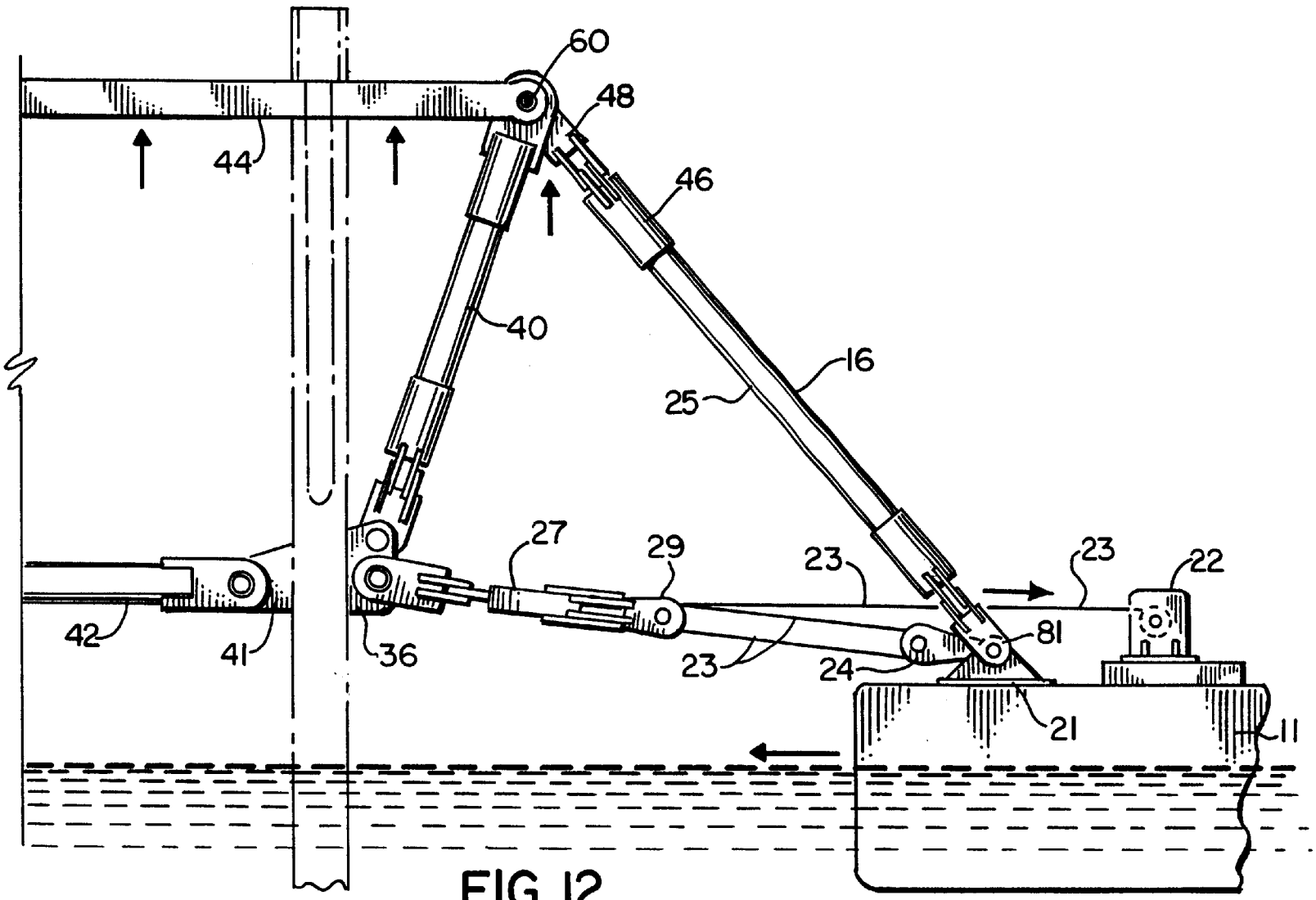
FIG. 12 is a partial, elevational view of the apparatus of the present invention.

A winch (e.g. hydraulic)22 is also provided with each boom 13–20. In FIG. 12, a single winch 22 is shown for purposes of clarification. Winch cable 23 is wound upon winch 22. Winches 22 can be large, commercially available winches that are driven with diesel engines. Winch cable 23 is preferably a steel cable having a high tensile strength.

Figure 2:
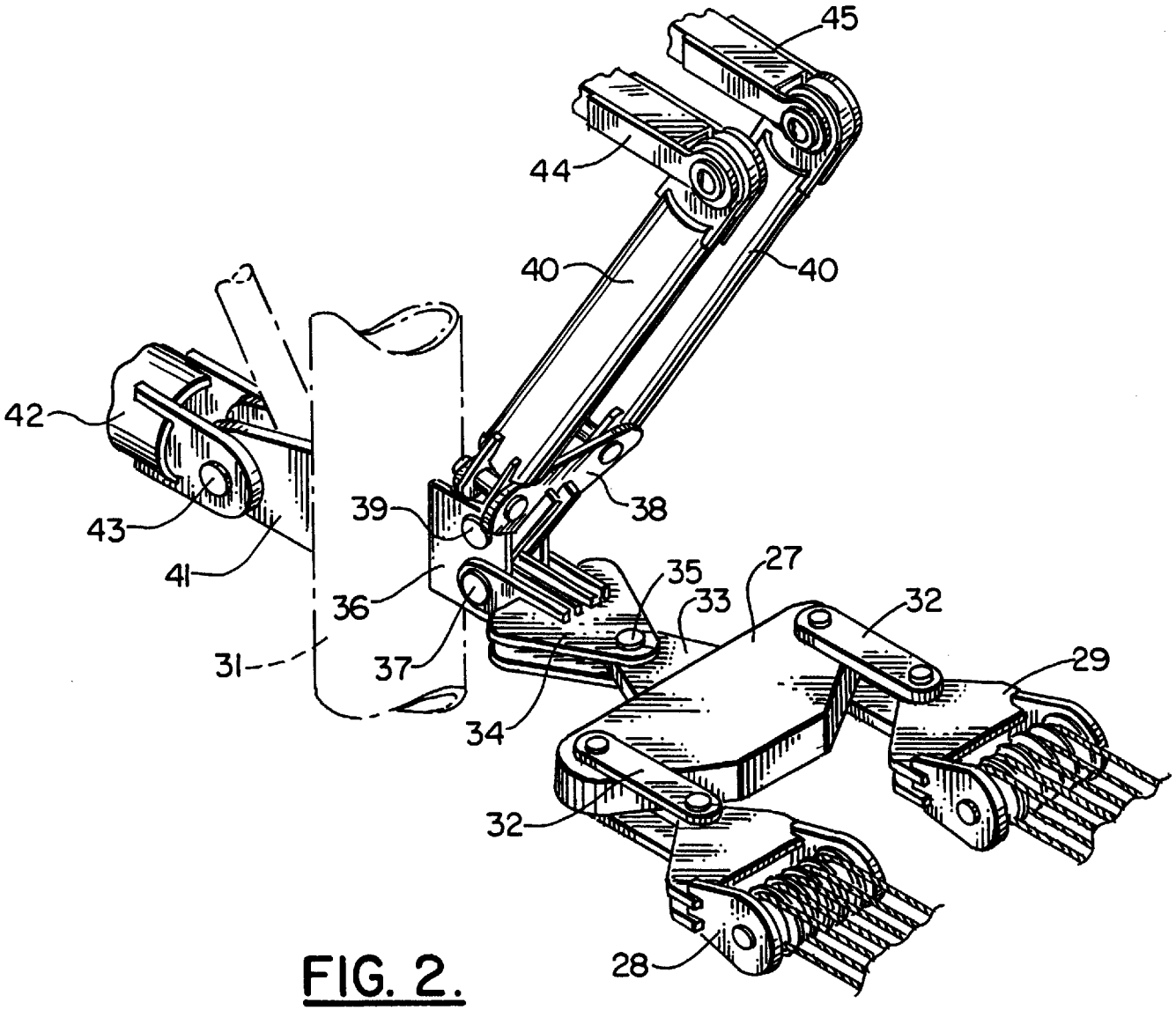
FIG. 2 is a partial perspective view of the preferred embodiment of the apparatus of the present invention showing the connection made between the lower end portion of the leg of a platform to be removed or installed and the apparatus of the present invention.

Sheave blocks are used to interface winch line 23 with the barges 11, 12 and the platform 30 to be salvaged or installed, as shown in FIGS. 1, 2 and 12. Sheave blocks 24 are pinned to base 21 at the lower end of each boom, In FIG. 12, boom 16 shows block 24 pivotally connected to base 21 at a pinned connection 81. Pinned connection 81 can be a common pinned connection that joins each boom to its base (e.g.

boom 16 to base 21 in FIG. 12) and also connecting sheave block 24 to base 21. As shown in FIG. 1, each boom 13–20 can be comprised of a pair of longitudinally extended boom members 25, 26. Each boom member 25, 26 pivotally mounts to a base 21 as shown in FIG. 1. Some or all of the bases 21 can be slidably or adjustably mounted to barge 11 or 12, enabling adjustment when booms 13–20 are positioned to lift platform 30 to be salvaged or installed. A load spreader 27 is part of the tension connection that extends between the base 21 of each boom 13–20 and platform 30 to be salvaged or installed at vertical leg 31. In FIG. 2, the load spreader 27 provides a pair of blocks 28, 29 connected thereto using links 32. Load spreader 27 has a pad eye 33 that attaches to block 34 with pinned connection 35. Leg 31 of platform 30 is provided with pad eyes 36, 41. Pad eye 36 forms a connection at pinned connection 37 to pad eye 34 as shown in FIG. 2. Similarly, a connection is formed between leg 31 at its pad eyes 36 with diagonal beams 40. A load spreader 38 forms an interface between the two diagonal beams 40 shown in FIG. 2 and leg pad eyes 36. A pinned connection 39 connects load spreader 38 to leg pad eye 36 as shown in FIG. 2.

Leg pad eyes 41 can be provided at about 180 degrees opposite to leg pad eyes 36. This enables a tensile connection to be perfected between barges 11 and 12 at each lifting boom 13–20. Horizontal beam 42 is connected to leg pad eye 41 at pinned connection 43. A tensile connection is formed between the winches 22 of barge 11 and the winches 22 of barge 12 at each aligned pair of booms such as boom 16 and boom 20. Each barge 11, 12 provides the connection shown in FIGS. 1 and 2 between an opposing pair of aligned booms (13 and 17, 14 and 18, 15 and 19, 16 and 20) and their base supports 21. For example, in FIG. 1, the boom 13 of barge 11 aligns with the boom 17 of barge 12. Likewise, the boom 16 of barge 11 aligns with the boom 20 of barge 12. The tensile connection shown in FIGS. 2 and 12 is representative of the connection made between each barge 11 and the vertical leg 31 of platform 30. The arrangement of boom 20 on barge 12 is thus a mirror image of FIG. 2. If the platform 30 does not have a horizontal beam spanning between two legs 31 at plates 41, and along a line that connects the bases 21 of an aligned pair of booms such as 16 and 20, horizontal beam 42 can be added using pinned connections 43 as shown in FIGS. 1, 2 and 12.

Horizontal beams 44, 45 each extend between the upper end of each boom (such as boom 16) and the associated, aligned boom such as boom 20 in FIG. 1. Preferably a pair of horizontal beams 44, 45 extend between the upper end portion of boom 16 and the upper end portion of boom 20. The connection between the aligned booms 16 and 20 with diagonal beams 40 and horizontal beams 44, 45 is best seen in FIGS. 1, 3, 4 and 12.

Figure 10:
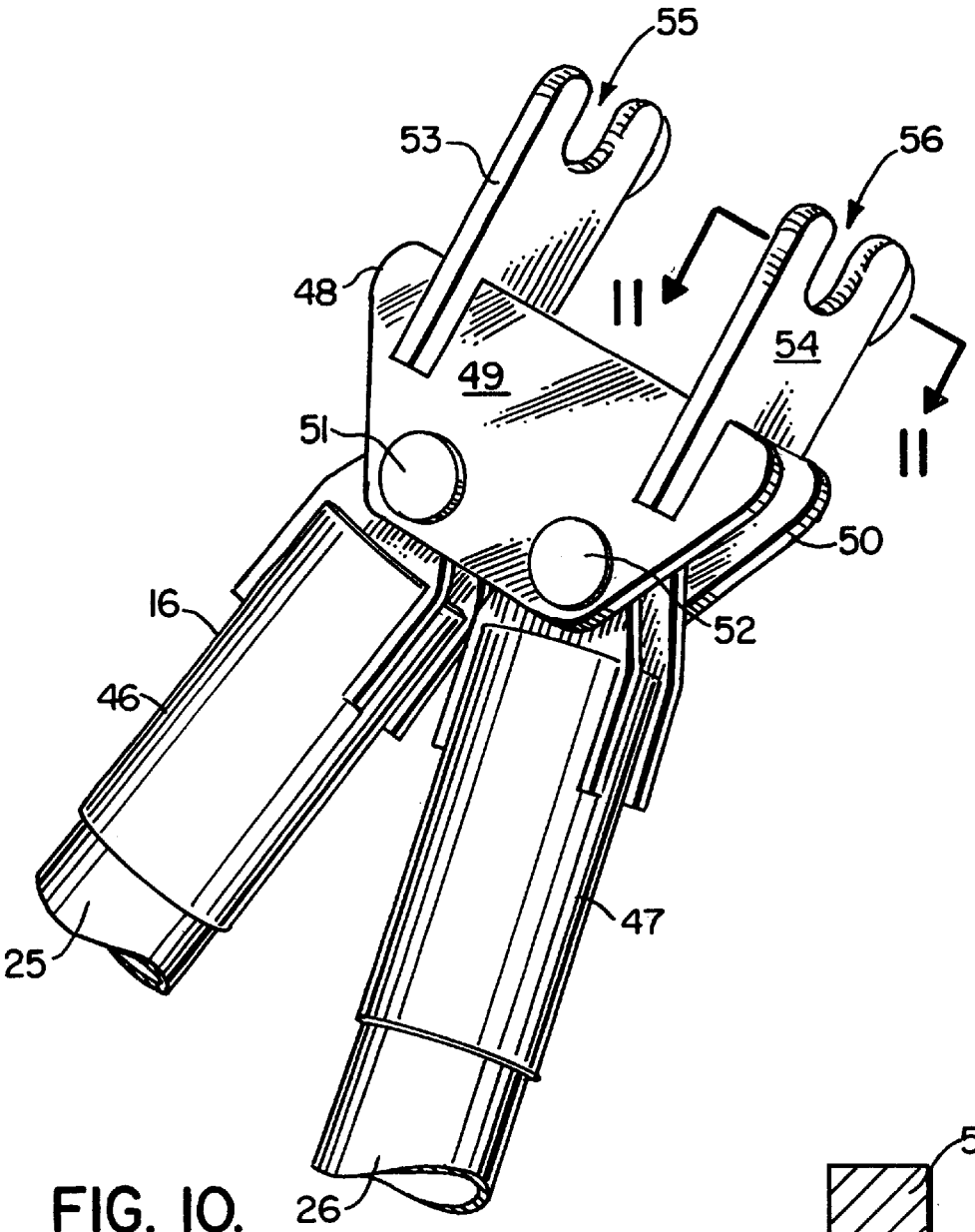
FIG. 10 is a fragmentary, perspective view of the preferred embodiment of the apparatus of the present invention showing an end of one of the lifting booms.

Each of the booms 13–20 can include removable end caps that are at end portions of the boom members 25, 26. As shown in FIG. 10, the upper end portion of each of the boom members 25, 26 can be provided with an end cap 46, 47, respectively. At the lower end of each boom member 25, 26, there can also be provided end caps 75. The end caps 75 at the lower end of the boom members 25, 26 can attach (e.g. pinned) to a pad eye block 77. A pinned connection 76 can be used to join the pad eye block 77 to base 21 of each boom 13–20. This construction that includes boom members 25, 26 and its removable end caps 46, 47, 77 enables the length of the booms 13–20 to be varied from one job to the next as the end caps 46, 47, 77 are reusable. By using different length boom members 25, 26, taller or shorter platforms 30 can be salvaged or installed.

Figure 3:
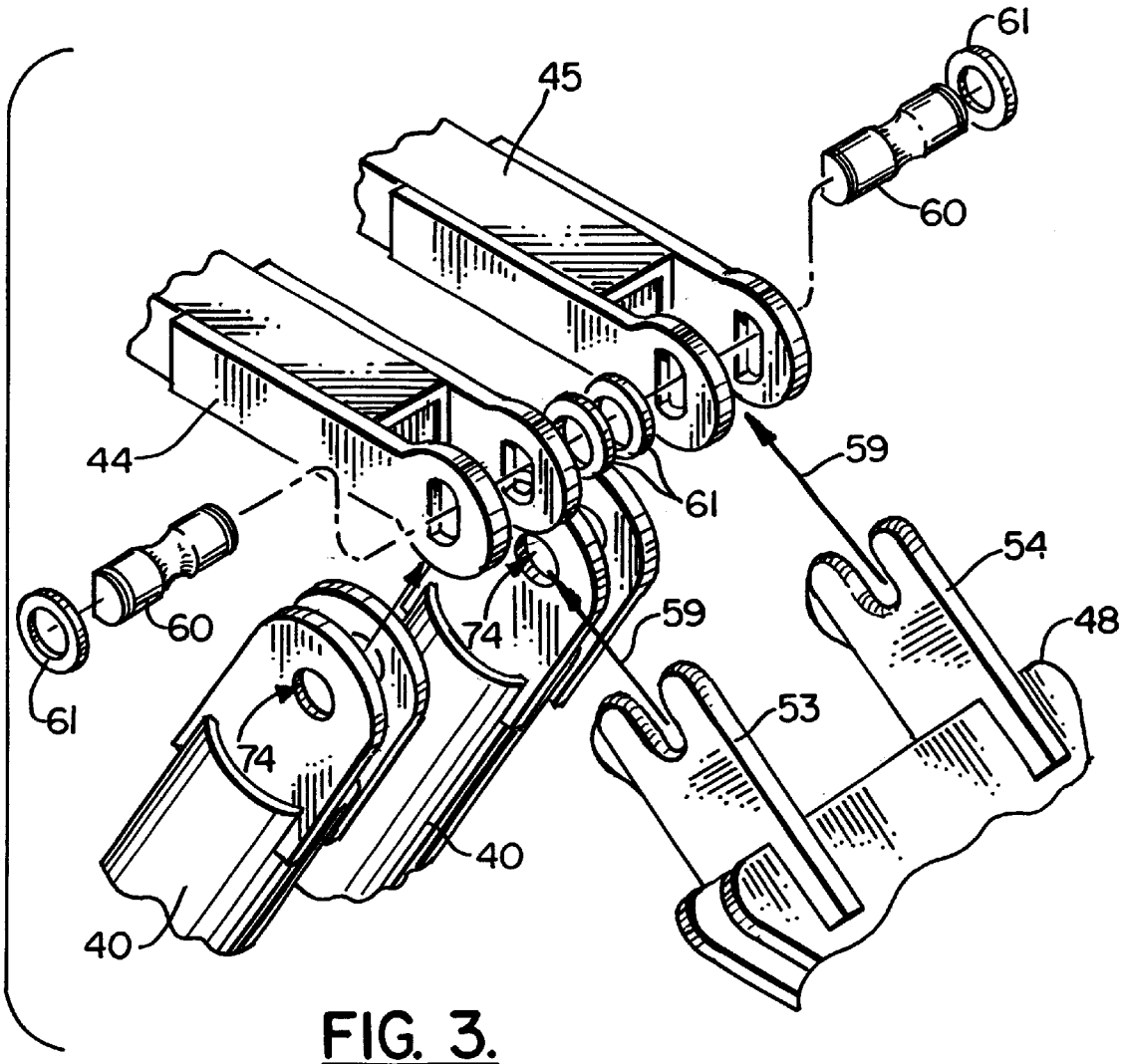
FIG. 3 is a fragmentary, exploded, perspective view of the preferred embodiment of the apparatus of the present invention.
Figure 4:
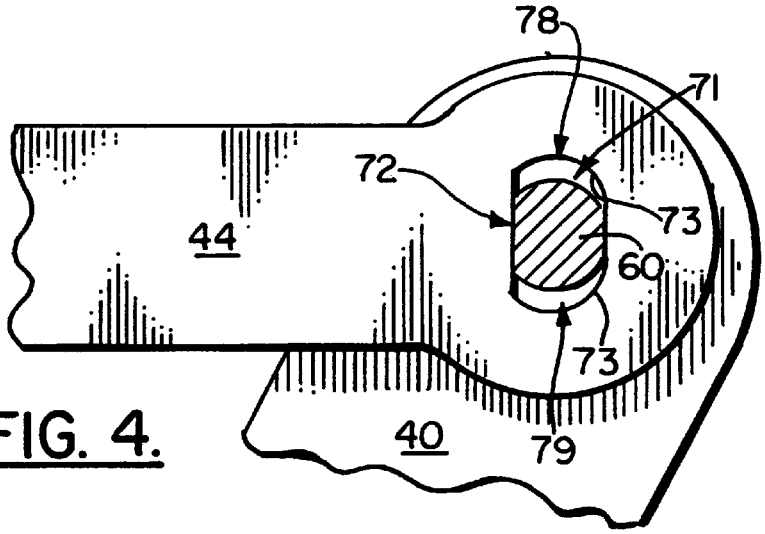
FIG. 4 is a fragmentary, sectional view of the preferred embodiment of the apparatus of the present invention illustrating the connection between horizontal and diagonal beam members.
Figure 5:
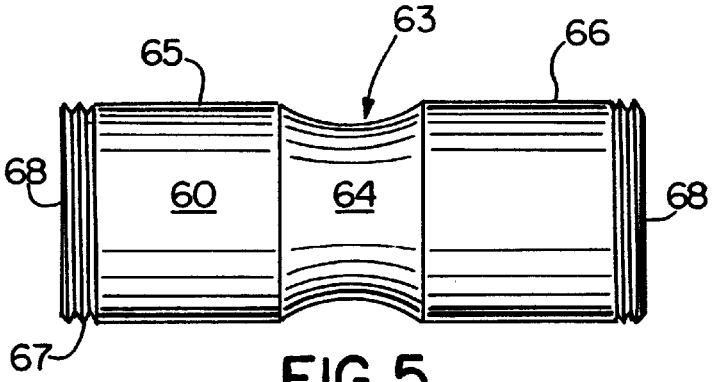
FIG. 5 is a fragmentary frontal view of the preferred embodiment of the apparatus of the present invention showing the pin portion thereof.
Figure 7:
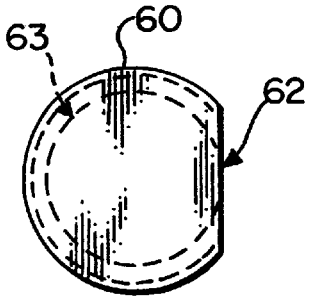
FIG. 7 is an end view of the pin portion of the preferred embodiment of the apparatus of the present invention.
Figure 6:
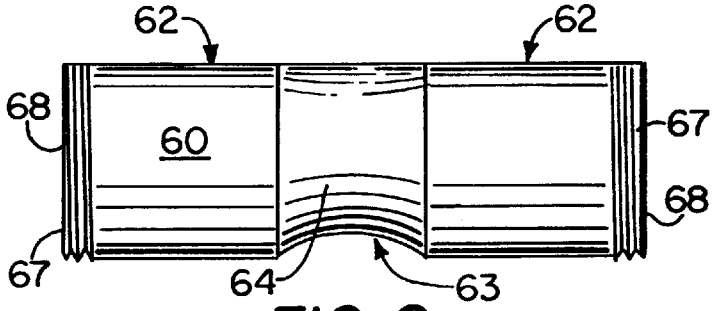
FIG. 6 is another view of the pin portion of the preferred embodiment of the apparatus of the present invention.
Figure 11:
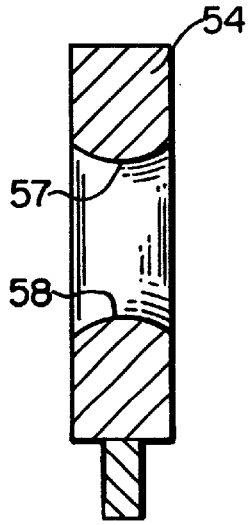
FIG. 11 is a sectional view taken along lines 11—11 of FIG. 10.

In FIG. 10, boom end 48 is attached to end caps 46, 47 using pinned connections 51, 52. Boom end 49 is comprised of a pair of plates 48, 50 that are welded to a second pair of plates 53, 54 as shown in FIG. 10. The plates 53, 54 each have a recess that fits a pin 60. The pin 60 connects diagonal beams 40 to horizontal beams 44, 50 as shown in FIGS. 2, 3 and 4. Plate 53 has recess 55. Plate 54 has recess 56. Each of the recesses 55, 56 provides a convex surface 57, 58 as shown in FIG. 11.

In FIG. 3, arrows 59 illustrate the assembly of plates 53, 54 that are part of boom end 48 to pins 60 that are connected to beams 40, 44 and 45. The ends of diagonal beams 40 align with the ends of the beams 44, 45 with pins 60 being placed through openings 71 of beams 44, 45 and 74 of beams 40.

Figure 8:
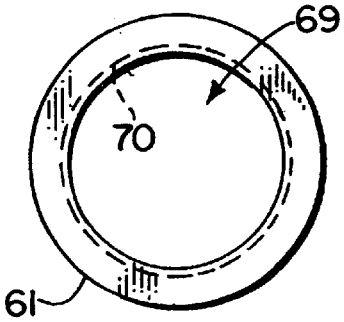
FIG. 8 is an end view of the retainer ring portion of the preferred embodiment of the apparatus of the present invention.
Figure 9:
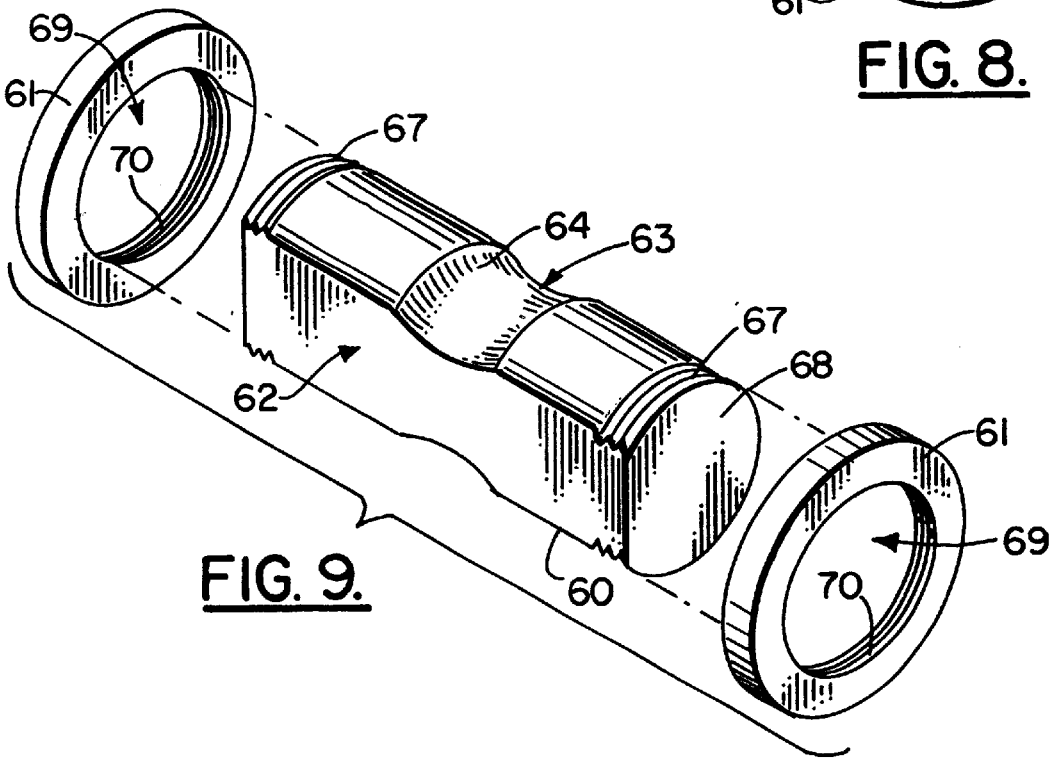
FIG. 9 is a fragmentary, perspective view of the preferred embodiment of the apparatus of the present invention illustrating the pin and retainer ring portions thereof.

The construction of pin 60 is shown more particularly in FIGS. 5–7 and 9. Also shown in FIGS. 8 and 9 is retainer 61 that holds each pin 60 in operating position. Pins 60 include spaced apart larger diameter sections 65, 66, each having external threads 67 at the extreme end 68 of pin 60. Ends 68 of pin 60 are generally flat. Retainers 61 have openings 69 with internal threads 70 that engage the external threads 67 of pin 60 upon assembly. Most of larger diameter sections 24, 25 are cylindrical in shape. However, pin 60 has a flat surface 62 (see FIG. 6) A center section 64 of pin 60 carries concave surface 63. During use, center section 64 of pin 60 is exposed so that it can be engaged by the convex surfaces 57, 58 of plates 53, 54 of boom end 48 at plates 53, 54 and recesses 55, 56.

It should be understood that the opening 71 at the end of each beam 45 is an enlarged or over sized opening defined by flat surface 72 and curved surface 73. In FIG. 4, pin 60 is shown having a maximum diameter that is smaller than the maximum height of opening 71, providing gaps at 78 and 79. This enables the pin 60 to travel up and down with respect to oversized opening 71 so that no substantial bending moment is created in beams 44, 45.

Conversely, diagonal beams 40 have pin openings 74 that are slightly larger than but substantially equal to the maximum diameter of large ends 65, 66 of pin 60.

PARTS LIST

| Part Number | Description |
|---|---|
| 10 | marine platform lifting apparatus |
| 11 | barge |
| 11A | deck surface |
| 12 | barge |
| 12A | deck surface |
| 13 | boom |
| 14 | boom |
| 15 | boom |
| 16 | boom |
| 17 | boom |
| 18 | boom |
| 19 | boom |
| 20 | boom |
| 21 | base |
| 22 | winch |
| 23 | winch cable |
| 24 | sheave block |
| 25 | boom member |
| 26 | boom member |
| 27 | load spreader |
| 28 | block |
| 29 | block |
| 30 | platform |
| 31 | vertical leg |
| 32 | link |

-continued

PARTS LIST

| Part Number | Description |
|---|---|
| 33 | pad eye |
| 34 | block |
| 35 | pinned connection |
| 36 | leg pad eye |
| 37 | pinned connection |
| 38 | load spreader |
| 39 | pinned connection |
| 40 | diagonal beams |
| 41 | leg pad eye |
| 42 | horizontal beam |
| 43 | pinned connection |
| 44 | horizontal beam |
| 45 | horizontal beam |
| 46 | end cap |
| 47 | end cap |
| 48 | boom end |
| 49 | plate |
| 50 | plate |
| 51 | pinned connection |
| 52 | pinned connection |
| 53 | plate |
| 54 | plate |
| 55 | recess |
| 56 | recess |
| 57 | convex surface |
| 58 | convex surface |
| 59 | arrow |
| 60 | pin |
| 61 | retainer |
| 62 | flat surface |
| 63 | concave surface |
| 64 | center section |
| 65 | larger diameter section |
| 66 | larger diameter |
| 67 | external thread |
| 68 | flat end |
| 69 | opening |
| 70 | internal thread |
| 71 | oversized pin opening |
| 72 | flat surface |
| 73 | curved surface |
| 74 | pin opening |
| 75 | end cap |
| 76 | pinned connection |
| 77 | pad eye block |
| 78 | gap |
| 79 | gap |
| 80 | gap |
| 81 | pinned connection |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A catamaran work barge apparatus for lifting a package to be salvaged or installed comprising:

a) a pair of barges, each defining a base that can support a large multi-ton load, each barge having a barge deck;

b) a plurality of diagonally extending lift booms supported upon each barge, each lift boom having a lower end portion attached to a barge and an upper end portion that includes a free end with a lifting end portion;

c) lower connection members for forming attachments of the barges to the package to be lifted; and d) a supplemental lifting frame that is connectable to the package and including a receptacle that receives the boom lifting free end portion.

2. The catamaran work barge apparatus of claim 1 wherein the frame includes a horizontal beam and a diagonal beam.

3. The catamaran work barge apparatus of claim 2 wherein there are at least two lifting booms on each barge.

4. The catamaran work barge apparatus of claim 2 further comprising horizontal load spreader surfaces spaced generally on opposite sides of the package being lifted.

5. The catamaran work barge apparatus of claim 2 wherein the booms include two opposing booms that are pinned respectively to different of the barges, and which booms are angularly disposed with respect to each other during use, wherein end caps form a detachable interface between each boom and its barge.

6. The catamaran work barge apparatus of claim 1 wherein the lower connection member includes a cable.

7. The lifting apparatus of claim 1 wherein the supplemental lifting frame comprises horizontal beams that span between booms on opposite barges, diagonal members that extend from an end portion of a horizontal beam to a lower end portion of the platform and a connection that joins the horizontal beams and diagonal members with a pinned arrangement that disallows substantial bending moment in the horizontal beam at the boom tip.

8. The lifting apparatus of claim 1 wherein the supplemental lifting frame comprises generally horizontal beams that span between booms on opposite barges, diagonal members that extend from an end portion of a horizontal beam to the lower end portion of the package next to a package leg and a connection that joins the diagonal beams and lower end portion of the platform with a structural arrangement that disallows substantial bending moment in the package leg.

9. The apparatus of claim 1 wherein the lower connection members include cables that span between the barges and the package.

10. The lifting apparatus of claim 9 wherein there is a winch positioned next to each boom at the barge deck.

11. The lifting apparatus of claim 1 wherein each lower connection member includes a winch and a cable wound upon the winch.

12. The apparatus of claim 10, wherein there are two opposed barges in step "a" that are floating barges.

13. The apparatus of claim 10, wherein the frame includes a plurality of beams.

14. A method for the offshore salvage or installation of a fixed offshore platform comprising the steps of:

a) transporting a catamaran work platform to a desired site of the fixed offshore structure, that includes a pair of barge supported decks that are positioned at spaced apart and generally parallel positions relative to one another;

b) attaching a lifting assembly to the platform at multiple positions, including positions that are at least on generally opposite sides of the platform, and at upper and lower positions on the platform;

c) wherein in step "a" the lifting assembly further includes two opposed lifting booms, each connected by at least one lifting end portion to a frame that is attachable to the platform; and d) pulling the two barge decks together.

15. The method of claim 14, wherein the lifting assembly includes a horizontal beam that spans between the two opposed booms.

16. The method of claim 14, wherein the lifting assembly includes a laterally extending beam and further comprising the step of subjecting the laterally extending beam of the to compression only during the lift.

17. The method of claim 14, wherein the lifting assembly includes a plurality of diagonally extending lift booms, each removably connecting at its ends to one of the barges and to the platform with an end cap.

18. A method of salvage or installation of a marine structure, comprising the steps of:

a) attaching a lifting assembly to the said marine structure, said lifting assembly including a pair of barges, each barge having one or more booms thereon, said lifting assembly attaching to the marine structure at multiple elevational positions on the marine structure, including upper and lower positions that are at least on generally opposite sides of the marine structure;

b) structurally supporting each of the booms at the lower end portion thereof with one of the barges, each boom being pivotally attached to its barge;

c) attaching an auxiliary frame to the lifting assembly, wherein the auxiliary frame has receptacles thereon that receive the lifting end portion of a boom; and d) supporting the marine structure with the auxiliary frame; and e) lifting the marine structure with the lifting assembly.

19. The method of claim 18 further comprising the step of transporting the marine structure to a desired location using the barges.

20. The method of claim 18 wherein the barges are maintained in generally parallel to each other.

21. The method of claim 18 wherein winches are provided on the barges with cables wound thereon, the winches retract their cables and move the barges toward one another.

22. The method of claim 18 further comprising the step of severing the marine structure at or near the waterline.

23. A method for the offshore installation of an offshore package comprising the steps of:

a) transporting a catamaran work platform to a desired marine site of the offshore structure, the work platform including a pair of barge supported decks that are positioned at spaced apart positions relative to one another;

b) attaching a lifting assembly to the platform at multiple positions, including positions that are at least on generally opposite sides of the package;

c) wherein in step "a" the lifting assembly further includes two opposed inclined lifting booms, each connected by at least one lifting end portion to a frame that is attachable to the package; and d) moving the two barge decks together; and e) increase the inclination of each boom.

24. The method of claim 23 further comprising the step of attaching a tensile member between the barges for enabling the barges to be pulled together and step "d" comprises pulling the two barge decks together.

25. The method of claim 23 wherein in step "a" the barges are floating barges.

26. The method of claim 23 wherein the lifting assembly includes multiple inclined booms on each barge.

27. The method of claim 23 wherein step "b" includes providing winches on the barges and step "d" comprises pulling the barge decks together with the winches.

28. The method of claim 23 wherein in step "c" the frame has generally horizontal beam portions and further comprising in step "b" attaching each boom to a generally horizontal beam portion of the frame.

29. The method of claim 23 wherein in step "c" the lifting booms include end caps that enable removable connections to be made between each boom and its barge, and further comprising the steps of attaching the end caps to the barge and mounting the booms to the end caps.

* * * * *